US011259393B2

(12) United States Patent
Tateno et al.

(10) Patent No.: US 11,259,393 B2
(45) Date of Patent: Feb. 22, 2022

(54) ELECTRIC NEUTRALIZER, ELECTRONIC SCALE EQUIPPED WITH ELECTRIC NEUTRALIZER, AND NEUTRALIZATION METHOD

(71) Applicant: A&D COMPANY, LIMITED, Tokyo (JP)

(72) Inventors: Hiroaki Tateno, Saitama (JP); Yoshikazu Nagane, Saitama (JP)

(73) Assignee: A&D COMPANY, LIMITED, Tokyo (JP)

( * ) Notice: Subject to any disclaimer, the term of this patent is extended or adjusted under 35 U.S.C. 154(b) by 0 days.

(21) Appl. No.: 16/977,794

(22) PCT Filed: Mar. 13, 2018

(86) PCT No.: PCT/JP2018/009645
§ 371 (c)(1),
(2) Date: Sep. 2, 2020

(87) PCT Pub. No.: WO2019/175952
PCT Pub. Date: Sep. 19, 2019

(65) Prior Publication Data

US 2020/0413524 A1 Dec. 31, 2020

(51) Int. Cl.
*H05F 3/04* (2006.01)

(52) U.S. Cl.
CPC ..... *H05F 3/04* (2013.01)

(58) Field of Classification Search
CPC ... H05F 3/04; H05F 3/06; H01T 23/00; H01T 19/04

(Continued)

(56) References Cited

U.S. PATENT DOCUMENTS 8,587,917 B2 * 11/2013 Fujita ..... H01T 23/00 361/231
8,663,570 B2 * 3/2014 On ..... A61L 9/22 422/186.04

(Continued)

FOREIGN PATENT DOCUMENTS

DE 102006055121 A1 5/2007
JP 2007287334 A 11/2007

(Continued)

OTHER PUBLICATIONS

Extended European Search Report issued in the corresponding European Patent Application No. 18910142.1 dated Oct. 5, 2021.

(Continued)

*Primary Examiner* — Dharti H Patel
(74) *Attorney, Agent, or Firm* — Roberts Calderon Safran & Cole P.C.

(57) ABSTRACT

Provided are a static eliminator capable of performing quick static elimination while having a good ion balance, an electronic balance including the static eliminator, and a static eliminating method of the static eliminator. A static eliminator is provided which is configured to eliminate static from a static eliminating object by ions generated by applying high voltages to static eliminating needles, and has a high-speed static eliminating mode configured to eliminate static from a static eliminating object at a high speed, and a relaxation static eliminating mode to be executed by a voltage application method different from that of the high-speed static eliminating mode and configured to regulate ion balances of the static eliminating object and the area around of the static eliminating object. With this configuration, a static eliminator capable of quickly eliminating static from a specimen while having a good ion balance can be provided.

5 Claims, 8 Drawing Sheets

(58) Field of Classification Search
USPC ..... 361/231
See application file for complete search history.

(56) References Cited

U.S. PATENT DOCUMENTS

| | | | | |
|---|---|---|---|---|
| 9,025,302 | B2 * | 5/2015 | Hariya | H01T 23/00 361/230 |
| 10,476,240 | B2 * | 11/2019 | Domschat | B41F 13/02 |
| 10,910,186 | B2 * | 2/2021 | Nishida | H01T 23/00 |
| 2007/0133145 | A1 | 6/2007 | Sato et al. | |
| 2010/0033891 | A1 * | 2/2010 | Orihara | H01T 23/00 361/231 |

FOREIGN PATENT DOCUMENTS

| | | | |
|---|---|---|---|
| JP | 2009140742 | A | 6/2009 |
| JP | 2009-146676 | A | 7/2009 |
| JP | 2010190600 | A | 9/2010 |
| JP | 2012079714 | A | 4/2012 |
| JP | 5971158 | B2 | 8/2016 |

OTHER PUBLICATIONS

Office Action issued in the corresponding Japanese Patent Application No. 2020-505972 dated Sep. 21, 2021.

* cited by examiner (A)

(B)

(C)

(A)

(B)

(C)

(A)

(B)

(A)

(B)

(A)

(B)

ELECTRIC NEUTRALIZER, ELECTRONIC SCALE EQUIPPED WITH ELECTRIC NEUTRALIZER, AND NEUTRALIZATION METHOD

CROSS-REFERENCE TO RELATED APPLICATIONS

The present application is a U.S. National Phase of PCT/JP2018/009645 filed on Mar. 13, 2018. The disclosure of the PCT Application is hereby incorporated by reference into the present Application.

TECHNICAL FIELD

The present invention relates to a static eliminator that quickly eliminates static from a specimen while having a good ion balance, an electronic balance including the static eliminator, and a static eliminating method of the static eliminator.

BACKGROUND ART

An electronic balance to be used for precision analysis, etc., has an extremely high weighing sensitivity, and even static electricity of a specimen becomes a factor in causing a weighing error. On the other hand, an electronic balance with a windshield, including a static eliminator (ionizer) that neutralizes the electrical charge (hereinafter, referred to as "eliminating static") of a specimen by generating ions has been proposed (Patent Literature 1).

Here, when voltage application to a static eliminating needle that is provided in the static eliminator and emits ions is by the AC method, both of positive ions and negative ions can be emitted by one static eliminating needle, whereas the distance of static elimination is short and a fan or the like is required, and the amount of ions is small, so that static elimination takes time. When the DC method is used, at least two static eliminating needles are required, however, the amount of ions that are emitted is larger than that of the AC method, and ions can scatter far without wind, and the static eliminating time is short (refer to FIGS. 12 and 13).

As a voltage application method to further shorten the static eliminating time, a pulsed DC method is available. This is a method in which short-time plus-like DC voltage application/interruption are alternately repeated to a total of two static eliminating needles consisting of a positive electrode and a negative electrode to cause these static eliminating needles to emit negative ions and positive ions alternately (refer to FIG. 14). Ions can be scattered far as in the DC method, and in addition, the alternate emission of positive ions and negative ions prevents ions from being bonded to each other, so that the amount of ions to be used for static elimination is large, and the static eliminating time can be further shortened than that by the DC method.

CITATION LIST

Patent Literature

[Patent Literature 1]

Japanese Published Unexamined Patent Application No. 2010-190600

SUMMARY OF INVENTION

Technical Problem

However, the pulsed DC method has a problem in which ion balances of a specimen and the area around the specimen deteriorate under the influence of either positive or negative ions emitted last.

The present invention was made in view of this problem, and an object of the present invention is to provide a static eliminator that quickly eliminates static from a specimen while having a good ion balance, an electronic balance including the static eliminator, and a static eliminating method of the static eliminator.

Solution to Problem

In order to solve the problem described above, a static eliminator of the present disclosure is a static eliminator configured to eliminate static from a static eliminating object by ions generated by applying a high voltage to a static eliminating needle, and has a high-speed static eliminating mode configured to eliminate static from the static eliminating object at a high speed, and a relaxation static eliminating mode to be executed by a voltage application method different from that of the high-speed static eliminating mode and configured to regulate ion balances of the static eliminating object and the area around the static eliminating object.

Preferably, the high-speed static eliminating mode is executed by voltage application to the static eliminating needle by a pulsed DC method, and the relaxation static eliminating mode is executed by voltage application to the static eliminating needle by a DC method.

Preferably, a pulse period in the pulsed DC method is determined according to a distance from the static eliminating needle to the static eliminating object.

Preferably, a table of optimum periods with respect to each distance from the static eliminating needle to the static eliminating object, or a function of an optimum period with respect to the distance from the static eliminating needle to the static eliminating object is stored in advance, and as the pulse period in the pulsed DC method, an optimum period obtained from the table or the function is used.

Preferably, the relaxation static eliminating mode is executed following execution of the high-speed static eliminating mode.

Further, an electronic balance including a static eliminator is provided which includes a placing pan on which a specimen can be placed, a windshield configured to cover the placing pan and define a weighing chamber, and the static eliminator disposed inside the weighing chamber, wherein voltage application in the high-speed static eliminating mode is performed by a pulsed DC method using a period determined according to a distance corresponding to a distance from a center position of the placing pan to the static eliminator.

Further, as a static eliminating method, a static eliminating method is provided which uses a static eliminator configured to eliminate static from a static eliminating object by ions generated by applying a high voltage to a static eliminating needle, and includes a high-speed static eliminating step of eliminating static from the static eliminating object at a high speed, and a relaxation static eliminating step of regulating ion balances of the static eliminating object and the area around the static eliminating object, which is performed by a voltage application method different from that of the high-speed static eliminating mode.

Effect of Invention

According to the configuration of the present disclosure, a static eliminator that quickly eliminates static from a specimen while having a good ion balance, an electronic balance including the static eliminator, and a static eliminating method of the static eliminator can be provided.

BRIEF DESCRIPTION OF DRAWINGS

FIGS. 3(A) and 3(B) are graphs illustrating voltages and ion outputs of static eliminating needles, in which FIG. 3(A) is a positive electrode, and FIG. 3(B) is a negative electrode.

FIGS. 6(A) and 6(B) are schematic views illustrating test conditions in FIG. 5, in which FIG. 6(A) is a plan view, and FIG. 6(B) is a right side view.

FIGS. 7(A), 7(B), and 7(C) are graphs illustrating charged voltage changes of a specimen (acrylic board) in respective modes, in which FIG. 7(A) illustrates a case where only a high-speed static eliminating mode M1 was executed, FIG. 7(B) illustrates a case where only a relaxation static eliminating mode M2 was executed, and FIG. 7(C) illustrates a case where both of the high-speed static eliminating mode M1 and the relaxation static eliminating mode M2 were executed.

FIGS. 8(A), 8(B), and 8(C) are graphs illustrating charged voltage changes of a windshield in respective modes, in which FIG. 8(A) illustrates a case where only the high-speed static eliminating mode M1 was executed, FIG. 8(B) illustrates a case where only the relaxation static eliminating mode M2 was executed, and FIG. 8(C) illustrates a case where both of the high-speed static eliminating mode M1 and the relaxation static eliminating mode M2 were executed.

FIGS. 9(A) and 9(B) are schematic views illustrating test conditions in FIG. 8, and depict an electronic balance, in which FIG. 9(A) is a plan view, and FIG. 9(B) is a front view.

FIGS. 11(A) and (B) depict a modification of the present invention, and are graphs illustrating voltages and ion outputs of static eliminating needles, in which FIG. 11(A) is a positive electrode, and FIG. 11(B) is a negative electrode.

FIGS. 13(A) and (B) are graphs illustrating voltages and ion outputs by the DC method, in which FIG. 13(A) is a positive electrode, and FIG. 13(B) is a negative electrode.

FIGS. 14(A) and (B) are graphs illustrating voltages and ion outputs in a pulsed DC method, in which FIG. 14(A) is a positive electrode, and FIG. 14(B) is a negative electrode.

DESCRIPTION OF EMBODIMENT

Figure 1:
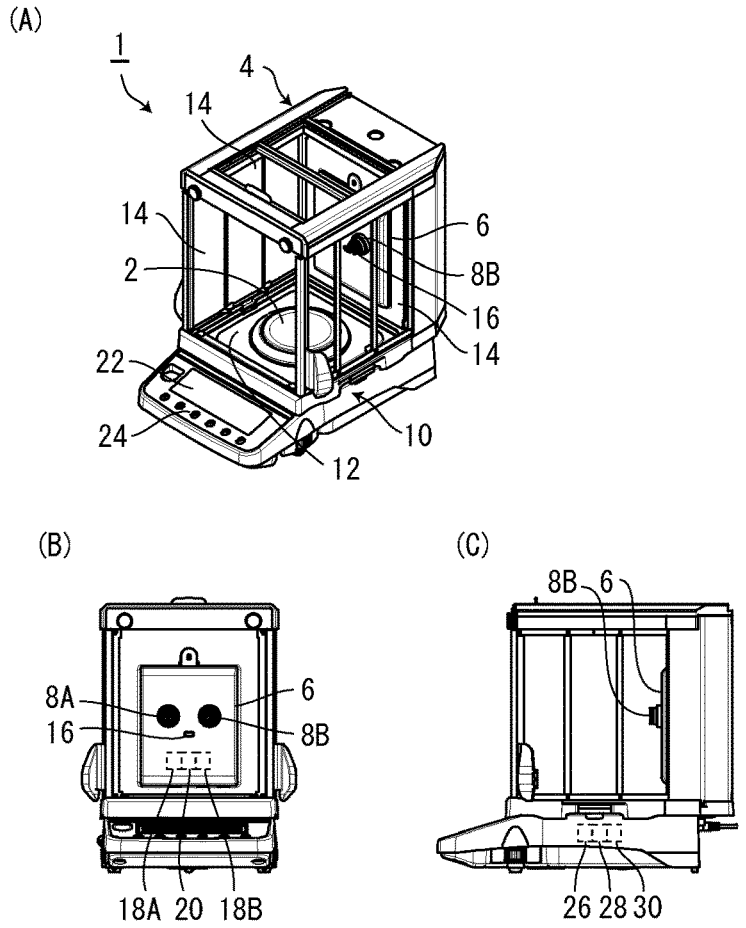
FIG. 1(A) is a perspective view of an electronic balance including a static eliminator according to an embodiment of the present invention.
FIG. 1(B) is a front view.
FIG. 1(C) is a right side view.
Figure 2:
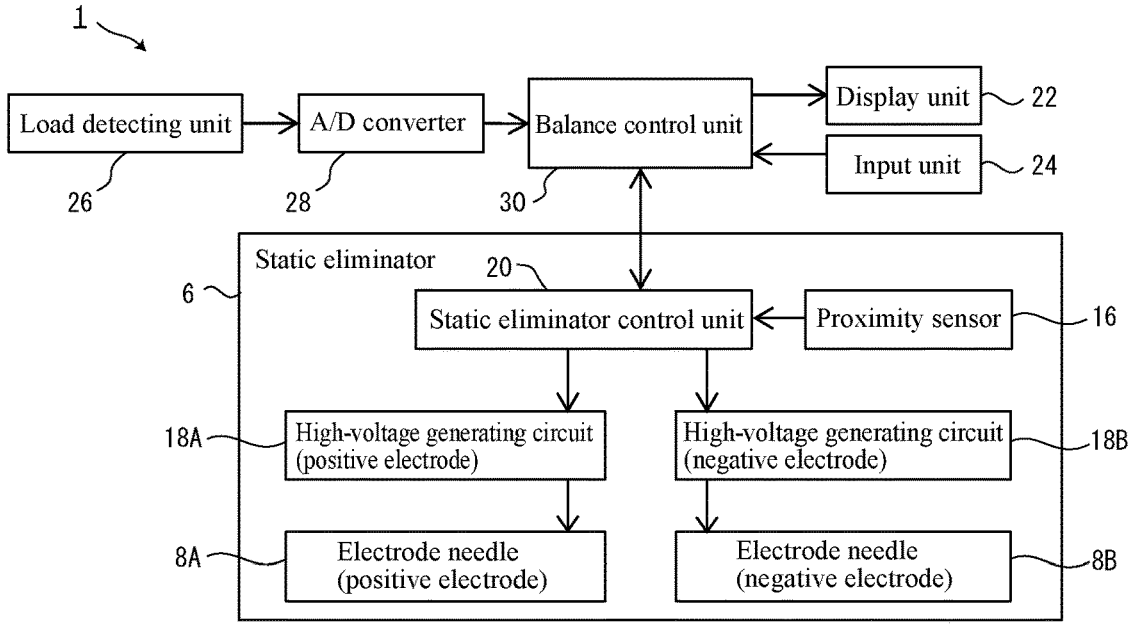
FIG. 2 is a block diagram of the same electronic balance.

Hereinafter, a preferred embodiment of a static eliminator according to a configuration of the present disclosure is described according to the drawings. FIG. 1 depict an electronic balance 1 including a static eliminator according to the present embodiment, and FIG. 2 is a block diagram of the electronic balance 1.

(Configuration of Electronic Balance)

The electronic balance 1 includes a balance main body 10, a windshield 4 disposed at an upper portion of the balance main body 10 and mounted on the balance main body 10, and a static eliminator 6 disposed inside the windshield 4.

The balance main body 10 has, on an upper surface thereof, a weighing pan 2 on which a specimen is placed, and inside the balance main body 10, a load detecting unit 26 that detects a load placed on the weighing pan 2, an A/D converter 28 that converts a detected analog signal to a digital signal, and a balance control unit 30, are housed. The balance control unit 30 is a microcontroller configured by mounting a CPU, a memory, etc., on an integrated circuit, and controls the balance main body 10 and the static eliminator 6 based on a program stored in the memory. On a front upper surface of the balance main body 10, a display unit 22 of a display that displays weighing results and a status, etc., and an input unit 24 as switches to input commands are provided.

The windshield 4 defines a weighing chamber 12 inside which the weighing pan 2 is disposed. Each of left, right, and upper walls of the weighing chamber 12 has a door 14 as an entrance and exit of the weighing chamber 12, and on a rear wall of the weighing chamber 12, the static eliminator 6 is disposed. The left, right, and upper walls (including the doors 14) and a front wall of the weighing chamber 12 are made of a transparent resin or glass so as to facilitate observation of the internal state.

The static eliminator 6 generates high voltages by high-voltage generating circuits (a positive electrode 18A and a negative electrode 18B) provided inside, and by applying these high voltages to static eliminating needles (a positive electrode 8A and a negative electrode 8B), causes corona discharge so as to emit positive ions from the static eliminating needle 8A of the positive electrode and negative ions from the static eliminating needle 8B of the negative electrode toward the front side, respectively. This high-voltage application is performed by the DC method, and needs two or more static eliminating needles 8, however, as compared with the AC method that is also a voltage application method, the amount of ions to be lost due to ionic bond is smaller, so that the amount of ions that can be used for static elimination is larger, and the amount of charge can be significantly reduced in a short time with respect to a specimen to be static eliminated. In addition, as compared with the AC method, ions can be scattered far, so that an ion blowing fan is unnecessary. No air flow is generated, so that the effect on weighing is small. The two static eliminating needles (8A and 8B) are juxtaposed on the left and right while being spaced from each other.

A proximity sensor 16 is an electronic device that can switch between ON/OFF by simply approaching the sensor without touching it. The static eliminator 6 has the proximity sensor 16 on a main body surface, and a signal is transmitted to start static elimination by the user simply bringing his or her hand or a specimen close to the proximity sensor 16. The proximity sensor 16 may be provided on the balance main body 10. Alternatively, a foot switch or the like that enables a user to perform turning ON/OFF with his/her foot may be provided separately so that the user can use his/her hands.

Control of the static eliminator 6 is performed by a built-in static eliminator control unit 20. The static eliminator control unit 20 is also a microcontroller configured by mounting a CPU, a memory, etc., on an integrated circuit, and controls voltage application to the respective static eliminating needles (8A and 8B) by controlling the high-voltage generating circuits (18A and 18B) in each mode described later. The static eliminator 6 itself is controlled by the balance control unit 30.

(Static Eliminating Method)

Figure 3:
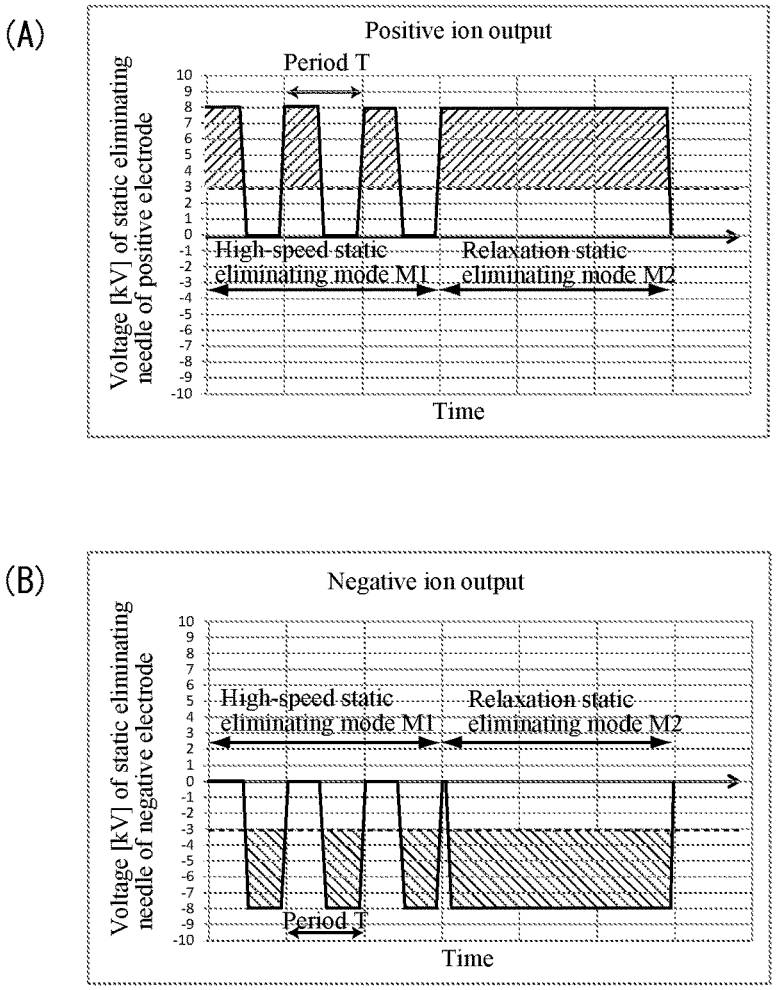
Figure 4:
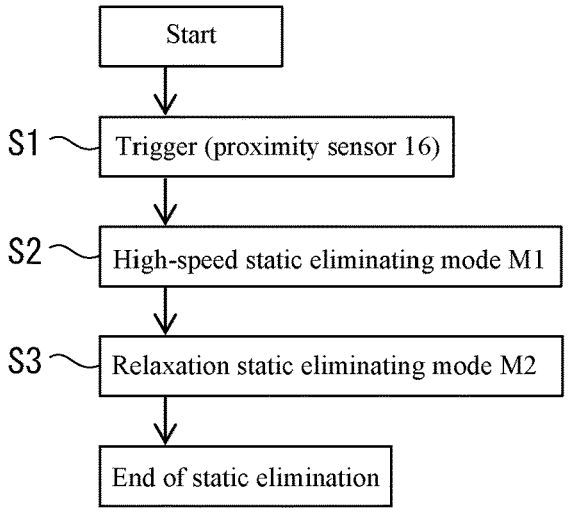
FIG. 4 is a flowchart of static elimination.

Next, a static eliminating method of the static eliminator 6 is described. FIG. 3 are graphs illustrating voltages and ion outputs of the static eliminating needles, in which FIG. 3(A) illustrates the positive electrode, and FIG. 3(B) illustrates the negative electrode, the horizontal axis represents time, and the vertical axis represents voltage. Ions are not generated unless the voltage becomes high to some extent, so that ions are output (emitted) only in the hatched regions. FIG. 4 is a flowchart of static elimination.

First, when a user opens the door 14 and tries to place a specimen inside the weighing chamber 12, the proximity sensor 16 reacts (S1) as a trigger, and the static eliminator 6 first executes a high-speed static eliminating mode M1 (S2) to eliminate static from the specimen at a high speed, and then, executes a relaxation static eliminating mode M2 (S3). After the relaxation static eliminating mode M2 is executed, the static elimination ends.

In the high-speed static eliminating mode M1, voltage applications to the static eliminating needles (8A and 8B) are performed by a pulsed DC method. The pulsed DC method is an application method in which short-time pulse-like voltage application/interruption are periodically repeated. One period (period T) of application/interruption is the same between the electrodes, and inverting voltage application is repeated in which voltages that have the same period T but are shifted by a half period from each other are alternately applied to the static eliminating needle 8A of the positive electrode and the static eliminating needle 8B of the negative electrode. For the period T, an optimum period To is selected, and the high-speed static eliminating mode M1 is executed with the optimum period To.

Here, the optimum period To is described. The pulsed DC method is excellent in decay time characteristics. While voltage of an electrically charged static eliminating object is gradually decreased by static elimination, the decay time characteristics mean a time to be taken until the voltage reaches an allowable voltage level, where the allowable voltage level is a voltage at which a weighing error does not become a problem. Therefore, the decay time characteristics can be said to be excellent when the voltage of a charged static eliminating object can be decreased to the allowable voltage level in a short time. In the pulsed DC method, the decay time characteristics relate to the distance L from the static eliminator to the static eliminating object and the pulse period T, and therefore, by selecting an optimum period To with respect to the distance L as the period T, the decay time characteristics can be further improved.

Figure 5:
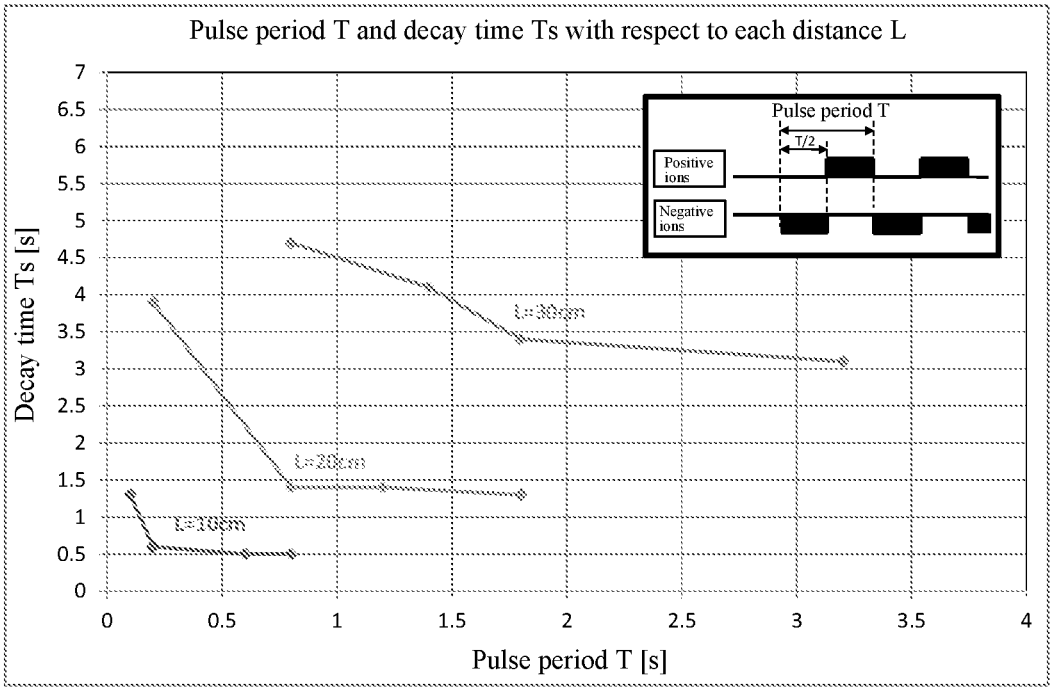
FIG. 5 is a graph illustrating relationships between a pulse period T and a decay time Ts with respect to each distance L from the static eliminating needles to a specimen.
Figure 6:
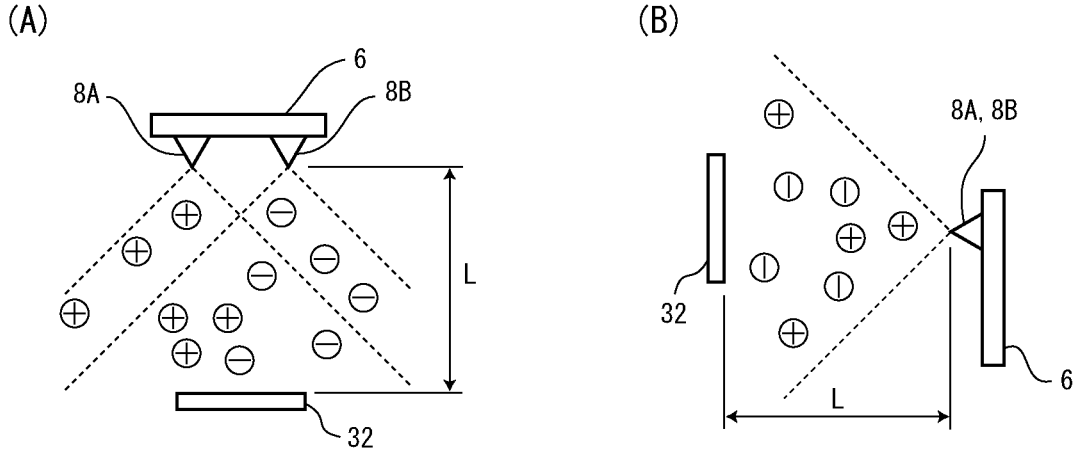

FIG. 5 is a graph of test data of the pulse period T and the decay time Ts when an acrylic board 32 was electrically charged as a test specimen and the high-speed static eliminating mode M1 was executed by the static eliminator 6. FIG. 6 are schematic views illustrating conditions of the test, in which FIG. 6(A) is a plan view, and FIG. 6(B) is a right side view. A time (decay time Ts) taken until the charged voltage of the acrylic board 32 reaches an allowable voltage level (here, set to 1/10 of the original charged voltage) was measured while changing the pulse period T with respect to each distance L.

As illustrated in FIG. 5, the optimum period To at which the decay time Ts becomes the shortest differs by distance L. A pulse period T that realizes excellent decay time characteristics tends to become shorter as the distance L becomes shorter.

A table of optimum periods To with respect to distances L or a function of the optimum period To with respect to the distance L, derived based on the test results, are stored in advance in the static eliminator control unit 20. By a configuration in which, in the high-speed static eliminating mode M1, a distance L from the static eliminator 6 to the static eliminating object is first acquired, and static elimination is performed by the pulsed DC method using an optimum period To obtained from the table or the function with respect to the distance L, the decay time characteristics are improved, and the static eliminating time can be shortened.

In the present embodiment, the static eliminator 6 is attached to the rear wall of the inside of the windshield 4, so that the distance L from the static eliminator 6 to the static eliminating object (a distance corresponding to a distance from a center position of the weighing pan 2 to the static eliminator 6) is almost constant, so that the optimum period To can be set in advance. A configuration is also preferable in which a distance sensor is added, a distance to a specimen is measured simultaneously with the start of static elimination, and based on the results of the measurement, an optimum period To is determined each time, and the high-speed static eliminating mode M1 is executed. A configuration is also preferable which enables a user to select or input a distance L with the input unit 24.

The pulsed DC method has an advantage in that the excellent decay time characteristics enable high-speed static elimination, however, positive ions and negative ions are alternately output, so that ions on the polarity side output last remain in the specimen and in the area around the specimen and tend to deteriorate the ion balance. As in the present embodiment, where the static eliminator 6 is installed inside the weighing chamber 12, the area around the static eliminator 6 is enclosed by walls, so that positive ions easily accumulate on an inner wall of the weighing chamber 12 closer to the static eliminating needle 8A of the positive electrode, and negative ions easily accumulate on an inner wall closer to the static eliminating needle 8B of the negative electrode. Accumulation of a large amount of ions (electric charge) may cause, for example, powder to be blown off when the powder is brought close. To remedy this problem, following the high-speed static eliminating mode M1, the relaxation static eliminating mode M2 is executed.

As illustrated in FIG. 3, in the relaxation static eliminating mode M2, voltage application is performed by the DC method in which voltages are simultaneously applied to both of the static eliminating needle 8A of the positive electrode and the static eliminating needle 8B of the negative electrode. Positive ions and negative ions are simultaneously emitted in the entire weighing chamber 12 and relax electric charge in the specimen and the area around the specimen in a well-balanced manner, and the ion balance in the weighing chamber 12 including both side inner walls of the weighing chamber 12 is improved.

In FIG. 3, the relaxation static eliminating mode M2 and the high-speed static eliminating mode M1 are assumed to have the same execution times, however, the execution time of the relaxation static eliminating mode M2 may be shorter than that of the high-speed static eliminating mode M1. It has been experimentally confirmed that the relaxation static eliminating mode M2 functions sufficiently even in a short time.

To determine each execution time, for example, the static eliminating time is selected from among 1 second, 3 seconds, and 10 seconds or a desired static eliminating time is manually input with the input unit 24. As an example, the execution time of the relaxation static eliminating mode M2 is fixed to 0.4 seconds, and a time obtained by subtracting the execution time of the relaxation static eliminating mode M2 from the input static eliminating time is the execution time of the high-speed static eliminating mode M1. It is also possible that a time ratio of the relaxation static eliminating mode M2 and the high-speed static eliminating mode M1 is stored in advance, and the static eliminating time is divided between the modes.

(Operation and Effect)

By the high-speed static eliminating mode M1 in which voltage application is performed by the pulsed DC method, the charge in a specimen is quickly relaxed. Although the specimen has already been static eliminated to the allowable voltage level by the high-speed static eliminating mode M1, the ion balance deteriorated by the ions on the polarity side emitted last is also relaxed by the relaxation static eliminating mode M2. The total static eliminating time for both modes is shorter than that in the DC method or in the AC method, and residual charge caused by the pulsed DC method is also relaxed by the relaxation static eliminating mode M2, so that the charge eliminating performance is high in total. The high-speed static eliminating mode M1 and the relaxation static eliminating mode M2 use different voltage application methods, and static elimination can be performed by utilizing the advantages of the respective voltage application methods.

There is a concern that the ion balance may be lost due to electric charge remaining in the specimen and the area around (the weighing chamber 12 in the present embodiment) the specimen in the high-speed static eliminating mode M1, and electrical charging of the weighing chamber 12 due to repeated static elimination may cause a weighing error by electrical charging of the weighing chamber 12, however, these can be prevented by the relaxation static eliminating mode M2.

Further, as the period T of voltage application in the high-speed static eliminating mode M1, an optimum period To corresponding to the distance L from the static eliminator to the static eliminating object is selected, so that the specimen can be static eliminated at a higher speed.

The relaxation static eliminating mode M2 is executed following the high-speed static eliminating mode M1, so that loss of the ion balance in the weighing chamber 12 is immediately relaxed. Therefore, since the ion balance is not left in an unbalanced state, adverse effects of static elimination on weighing can be minimized.

In the present embodiment, the static eliminator 6 is installed inside and integrated with the windshield 4, and static elimination can be performed in the weighing chamber 12, and this is highly convenient. In addition, the distance L from the static eliminator 6 to the weighing pan 2 is almost constant, so that the optimum period To is selected from the beginning, and a specimen is subjected to high-speed static elimination by only placing the specimen into the weighing chamber 12 for weighing, so that the work efficiency is high.

(Experimental Results)

Figure 7:
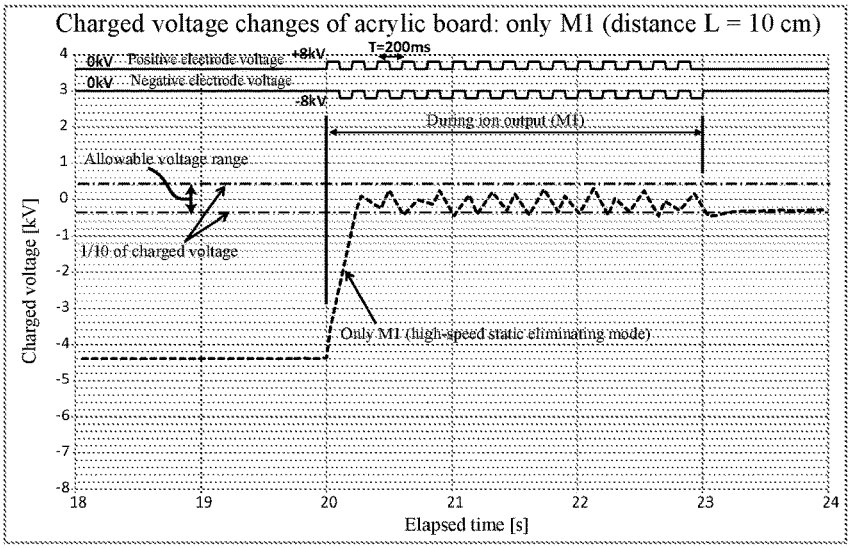
Figure 7:
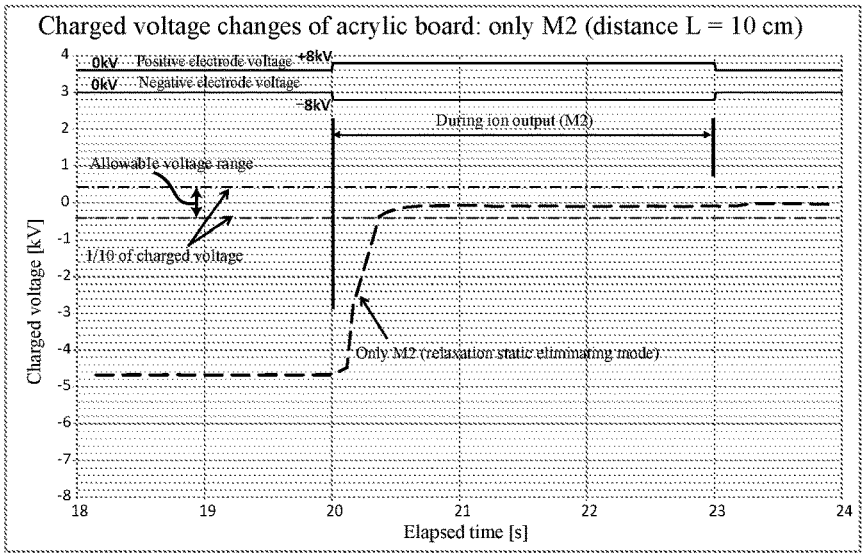
Figure 7:
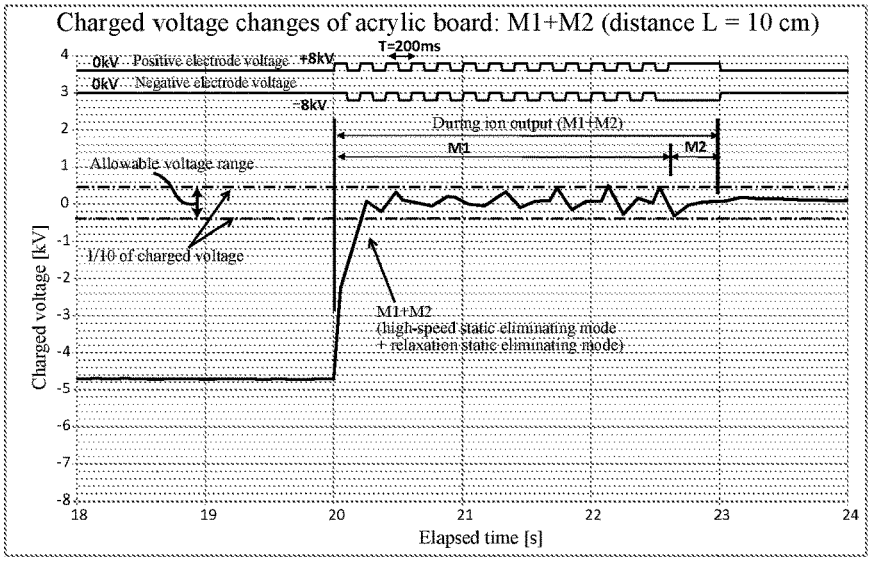

FIG. 7 are graphs of the results of the experiment performed to demonstrate the effect of the present embodiment, and charged voltage changes of the acrylic board 32 when the acrylic board 32 was electrically charged and static eliminated in the respective modes under the same test conditions as in FIG. 6 were measured. FIG. 7(A) illustrates results obtained when only the high-speed static eliminating mode M1 was executed, FIG. 7(B) illustrates results obtained when only the relaxation static eliminating mode M2 was executed, and FIG. 7(C) illustrates results obtained when the relaxation static eliminating mode M2 was executed after the high-speed static eliminating mode M1 was executed.

With the distance L from the static eliminator 6 to the acrylic board 32 of 10 cm, voltage application was performed by the pulsed DC method with a period T=200 ms as an optimum period selected from FIG. 5 in the high-speed static eliminating mode M1, and voltage application was performed by the DC method in the relaxation static eliminating mode M2. The static eliminating time was set to 3 seconds, and the relaxation static eliminating mode M2 was for 0.4 seconds in FIG. 7(C). The voltage of the positive electrode/the voltage of the negative electrode to be applied to the respective static eliminating needles (8A and 8B), and an allowable voltage range obtained by setting a voltage that is 1/10 of an initial charged voltage of the acrylic board 32 as an allowable voltage level are added to the respective graphs.

As illustrated in FIG. 7, in the high-speed static eliminating mode M1, the charged voltage linearly decreased from just after the start of static elimination, and the time (decay time) until reaching the allowable voltage level was shorter than in the case where only the relaxation static eliminating mode M2 was executed, so that excellent decay time characteristics were obtained. However, in the high-speed static eliminating mode M1, the voltage is applied by the pulsed DC method, so that negative ions and positive ions are alternately emitted, and the charged voltage fluctuates up and down around 0 and is unstable although it is within the allowable voltage level range, and the ion balance is poor. Therefore, by executing the relaxation static eliminating mode M2 after the high-speed static eliminating mode M1 (refer to FIG. 7(C)), the charged voltage can be stabilized at almost 0.

It was confirmed that, by performing static elimination at a high speed by executing the high-speed static eliminating mode M1, and subsequently executing the relaxation static eliminating mode M2, the acrylic board 32 as a whole could be quickly static eliminated and had a good ion balance.

In this experiment, the static eliminating time was set to 3 seconds by way of example, however, the static eliminating time can be made shorter, and even in this case, the effect can be sufficiently obtained. Even when the charge amount is large, static can be quickly eliminated to have a good ion balance.

Figure 8:
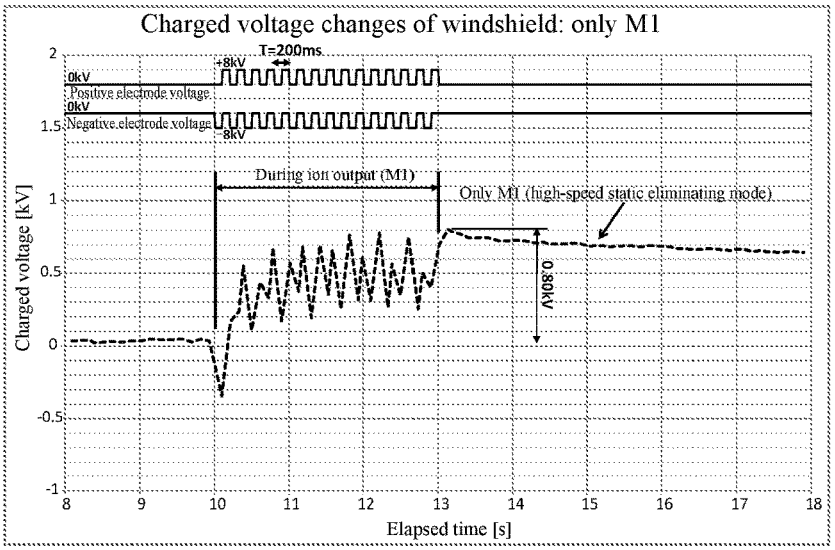
Figure 8:
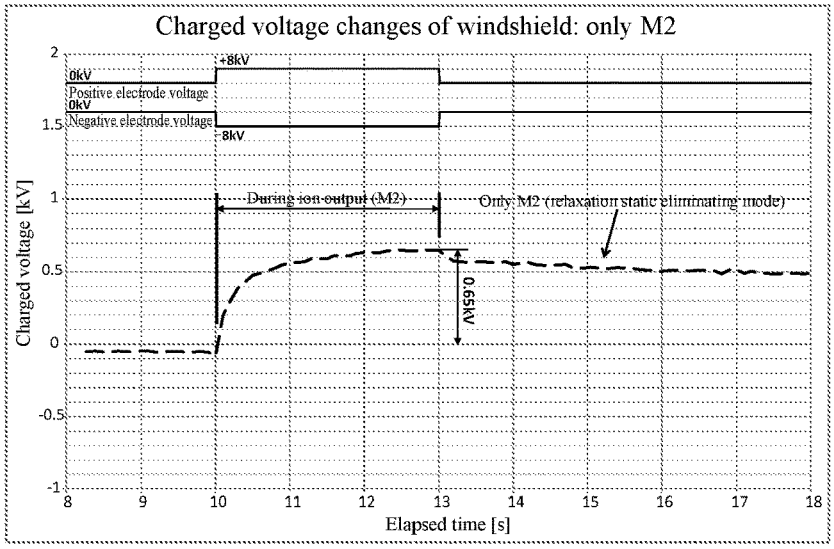
Figure 8:
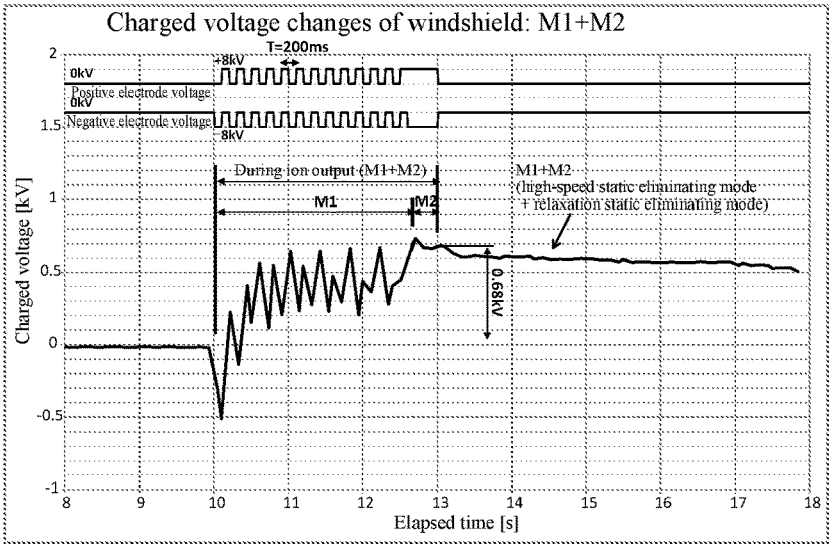
Figure 9:
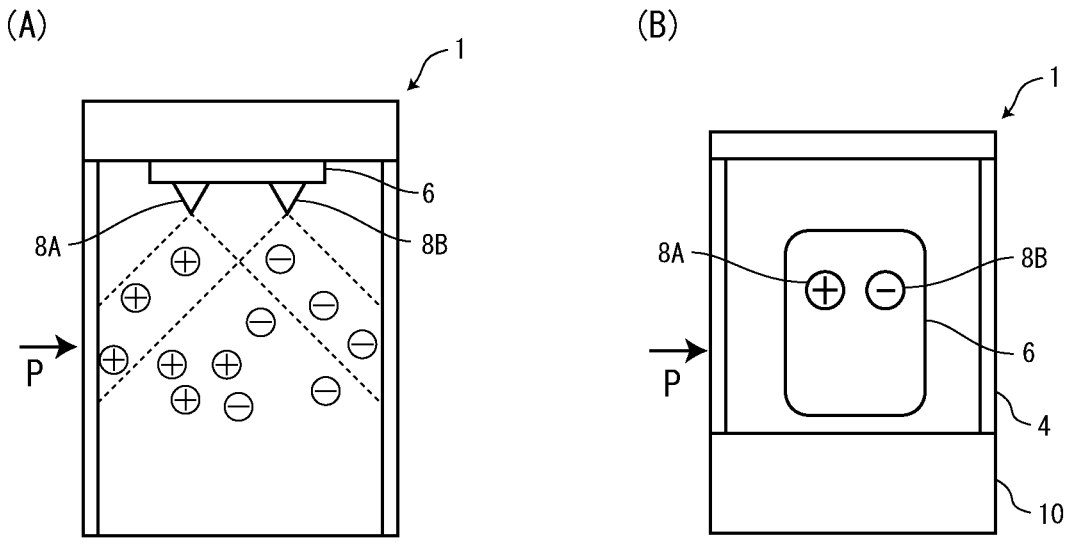

FIG. 8 are graphs illustrating results of another experiment conducted to further demonstrate the effect, for which charged voltages of the windshield 4 when the respective modes were executed were measured. FIG. 8(A) illustrates results obtained when only the high-speed static eliminating mode M1 was executed, FIG. 8(B) illustrates results obtained when only the relaxation static eliminating mode M2 was executed, and FIG. 8(C) illustrates results obtained when the relaxation static eliminating mode M2 was executed after the high-speed static eliminating mode M1 was executed. FIG. 9 are schematic views illustrating conditions of the test, and depict the electronic balance 1, in which FIG. 9(A) is a plan view, and FIG. 9(B) is a front view, and the arrows P in the drawings indicate charged voltage measurement positions on the windshield 4.

In the high-speed static eliminating mode M1, voltage application was performed by a pulsed DC method with a period T=200 ms, and in the relaxation static eliminating mode M2, voltage application was performed by the DC method. Ion output times in the respective modes were set to 3 seconds, and in FIG. 8(C), the relaxation static eliminating mode M2 was for 0.4 seconds.

As illustrated in FIG. 9, the charged voltage measurement position P on the windshield 4 is on a left side inner wall close to the static eliminating needle 8A of the positive electrode, and positive ions comparatively easily accumulate there, so that the charged voltages of the windshield 4 illustrated in FIG. 8 all changed to the positive side except the times just after the start of ion output.

As illustrated in FIG. 8(A), in the case where only the high-speed static eliminating mode M1 is executed, voltages are applied to the static eliminating needles (8A and 8B) by the pulsed DC method, and positive ions and negative ions are alternately output inside the windshield 4, so that the charged voltage repeatedly increases and decreases, however, positive ions are output last before end of the emission, and therefore, a charged voltage at the peak of the increase/decrease remains as it is, so that the charged voltage after the ion output is larger than in the case described later where only the relaxation static eliminating mode M2 is executed.

As illustrated in FIG. 8(B), in the case where only the relaxation static eliminating mode M2 is executed, voltages are applied to the static eliminating needles (8A and 8B) by the DC method, and positive ions and negative ions are simultaneously output inside the windshield, so that the charged voltage of the windshield 4 gradually changes, and the charged voltage after the ion output is smaller than in the high-speed static eliminating mode M1.

On the other hand, in the case where the relaxation static eliminating mode is executed after the high-speed static eliminating mode M1, as illustrated in FIG. 8(C), the charged voltage repeatedly increases and decreases, however, it was confirmed that by executing the relaxation static eliminating mode M2, the charged voltage after the ion output decreased to a level equivalent to that in the case of only the relaxation static eliminating mode M2.

In this way, the relaxation static eliminating mode M2 can improve not only the ion balance of the static eliminating object but also the ion balance in the area around (windshield 4) the static eliminating object.

Embodiment

Figure 10:
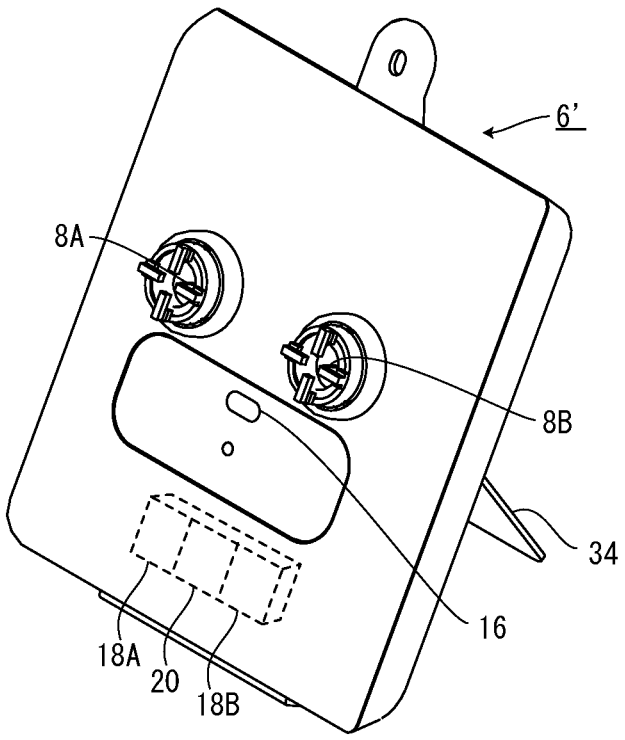
FIG. 10 is a perspective view of a static eliminator according to another embodiment of the present invention.

FIG. 10 is a perspective view of a static eliminator 6' as another embodiment of the present invention. The static eliminator 6' has the same configuration as that of the static eliminator 6 of the embodiment described above except that the static eliminator 6' is self-supporting by using a stand 34 equipped on its back surface, and can operate alone. The static eliminator 6' is configured to obtain electric power from an external power supply by a detachable cord.

When a specimen is brought close to the front of the static eliminator 6', the proximity sensor 16 operates as a trigger, and by application of high voltages generated by the high-voltage generating circuits (18A and 18B) provided inside, ions are emitted forward from the static eliminating needles (8A and 8B). Operating programs for the high-speed static eliminating mode M1 and the relaxation static eliminating mode M2 are stored in the static eliminator control unit 20 beforehand, and the static eliminator 6' operates alone in the same manner as the static eliminator 6 and performs static elimination. Static eliminating times in the respective modes are stored in advance in the static eliminator control unit 20.

There is a concern that, through repetition of the static eliminating operation, objects around the static eliminator 6' may be electrically charged, and static electricity may hurt the operator's fingers, however, this can be prevented since the ion balance therearound is improved by executing the relaxation static eliminating mode M2.

The static eliminator 6' may include an input unit 24 to enable detailed settings such as the execution time of the respective modes and the distance to the specimen.

(Modification)

In the above, a description has been given of embodiments of the present invention, however, the present invention is not limited to the embodiments described above, and can be variously modified and carried out.

Figure 11:
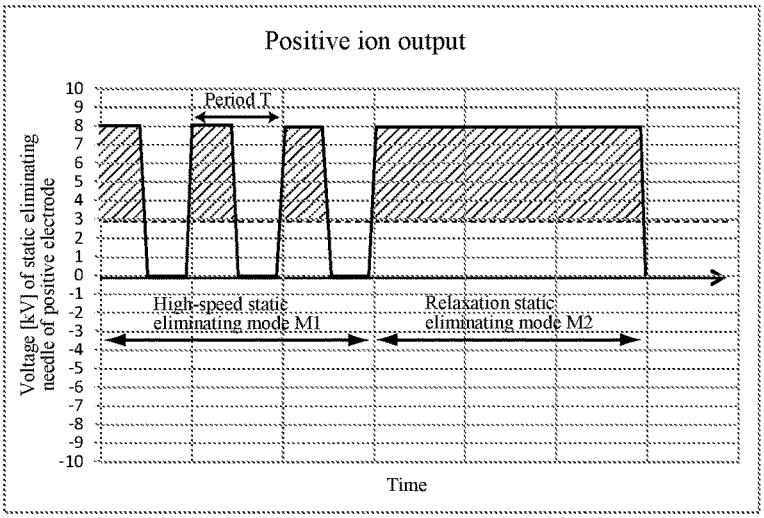
Figure 11:
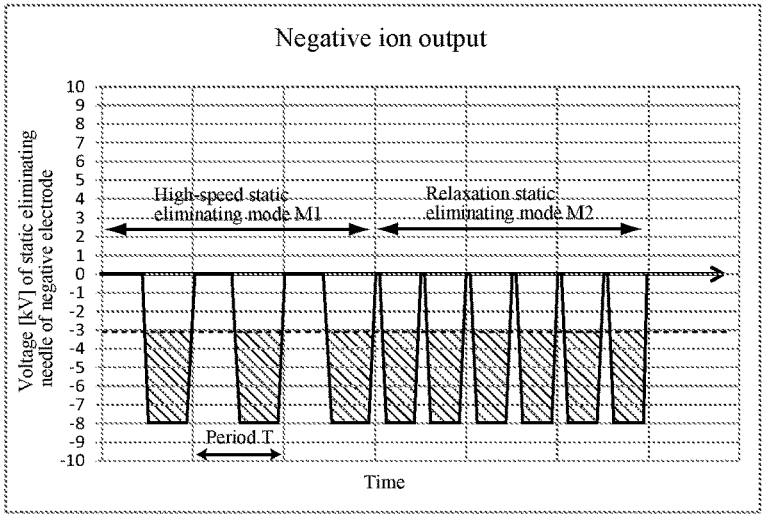
Figure 12:
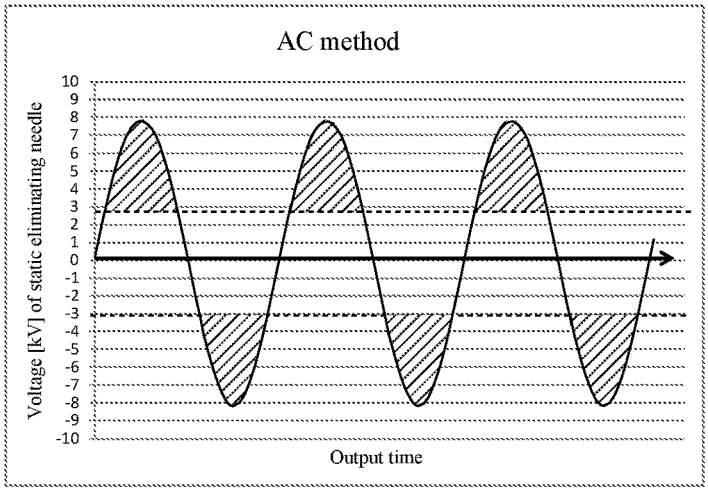
FIG. 12 is a graph illustrating a voltage and an ion output by the AC method.
Figure 13:
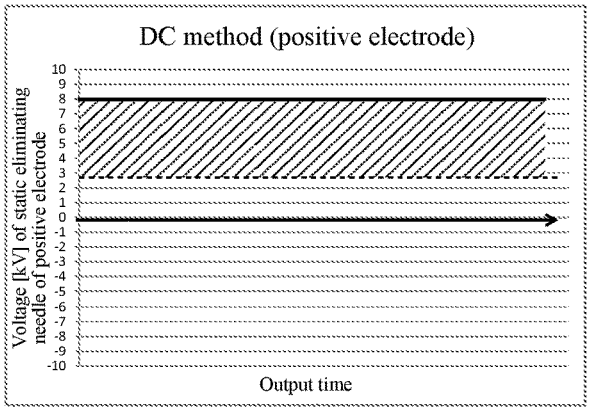
Figure 13:
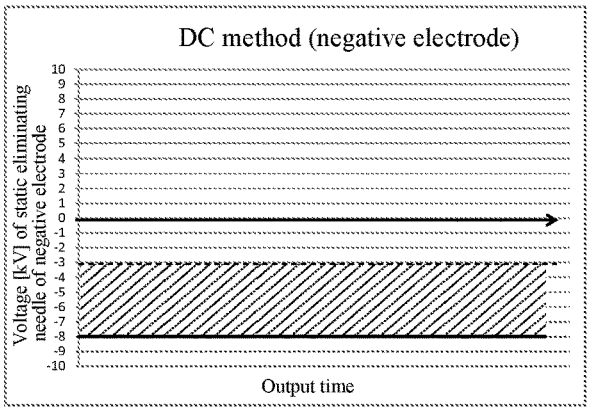
Figure 14:
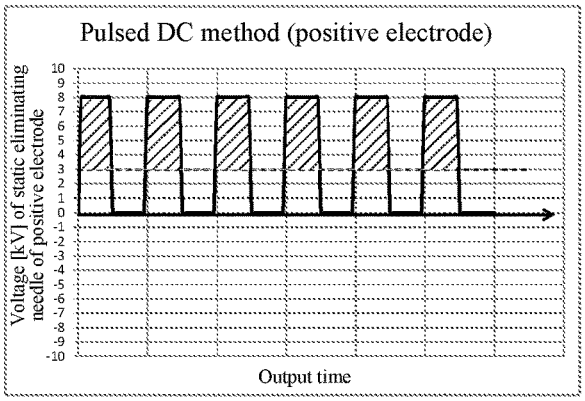
Figure 14:
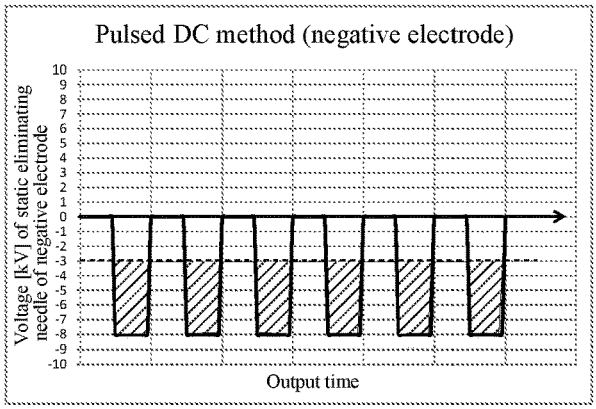

In the relaxation static eliminating mode M2, as illustrated in FIG. 11, either one of the voltages of the static eliminating needle 8A of the positive electrode and the static eliminating needle 8B of the negative electrode may be subjected to PWM control. In the high-speed static eliminating mode M1, ions on the polarity side emitted last, for example, negative ions in FIG. 11, become dominant in the specimen and the weighing chamber 12. Negative ions are light in weight and scatter far as compared with positive ions, and therefore, negative ions tend to remain. In the relaxation static eliminating mode M2, by adjusting the amount of ions to be emitted by applying PWM control to one of the voltages, the ion balance of the specimen and the ion balance in the weighing chamber 12 can be regulated satisfactorily. The amount of ions may be adjusted by decreasing either one voltage value to be low, instead of the PWM control.

Through repeated use of the static eliminating needles (8A and 8B), the needle of the static eliminating needle 8A of the positive electrode wears out, and dust easily attaches to the static eliminating needle 8B of the negative electrode. This deteriorates the performance, and even when the same voltage value is applied, the amount of ions to be emitted may differ. In this case as well, performing PWM control of the voltage of a specific electrode in the relaxation static eliminating mode M2 is effective.

It is preferable to provide the electronic balance 1 with a temperature/humidity sensor and configure the electronic balance 1 so that prior to weighing of a specimen, humidity measured by the temperature/humidity sensor is displayed as a numerical value on the display unit 22, and a user is informed of whether static elimination is necessary in response to the measured value. For example, whether static elimination is necessary is displayed on the display unit 22 in response to a detected humidity. As the display method, various methods are available, and for example, when the humidity is 40% RH in which static elimination is highly necessary, the numerical value of the humidity is displayed in red, when the humidity is between 40% RH and 60% RH and it is better to perform static elimination for the sake of certainty, the numerical value of the humidity is displayed in yellow, and when the humidity is 60% RH or more and static elimination is not necessary, the numerical value of the humidity is displayed in blue. It is also possible to configure the proximity sensor 16 such that turning ON/OFF can be set by the input unit 24, and a configuration may be made so that static elimination is automatically performed by automatic determination according to the conditions described above.

It is also preferable that the relaxation static eliminating mode M2 is made executable even alone, and is executed according to a command from the input unit 24, and a configuration is more preferable in which the charging state of the surrounding area is read by a sensor or the like, and the relaxation static eliminating mode M2 is automatically executed.

In the present embodiment, the static eliminating needles are two in number (8A and 8B), however, the number of static eliminating needles may be increased to four or more, and by increasing the number of static eliminating needles, the amount of ions to be emitted increases, and quicker static elimination becomes possible.

Although embodiments and modifications of the present invention have been described above, the embodiments and modifications can be combined based on knowledge of a person skilled in the art, and such a combined embodiment is included in the scope of the present invention.

REFERENCE SIGNS LIST

1 Electronic balance
2 Weighing pan
4 Windshield
6, 6' Static eliminator
8A Static eliminating needle (of positive electrode)
8B Static eliminating needle (of negative electrode)
10 Balance main body
12 Weighing chamber
18A High-voltage generating circuit (of positive electrode)
18B High-voltage generating circuit (of negative electrode)
20 Static eliminator control unit
30 Balance control unit
L Distance (distance between static eliminator and static eliminating object)
M1 High-speed static eliminating mode
M2 Relaxation static eliminating mode
T Period
To Optimum period

The invention claimed is:

1. A static eliminator configured to eliminate static from a static eliminating object by ions generated by applying a high voltage to a static eliminating needle, comprising:

a high-speed static eliminating mode configured to eliminate static from the static eliminating object at a high speed; and a relaxation static eliminating mode to be executed by a voltage application method different from that of the high-speed static eliminating mode and configured to regulate ion balances of the static eliminating object and the area around the static eliminating object, wherein the high-speed static eliminating mode is executed by voltage application to the static eliminating needle by a pulsed DC method, and the relaxation static eliminating mode is executed by voltage application to the static eliminating needle by a DC method, and the relaxation static eliminating mode is executed following execution of the high-speed static eliminating mode.

2. The static eliminator according to claim 1, wherein the relaxation static eliminating mode is executed following the high-speed static eliminating mode, and is executed in a shorter execution time than an execution time of the high-speed static eliminating mode.

3. An electronic balance including a static eliminator comprising:

a placing pan on which a specimen can be placed;

a windshield configured to cover the placing pan and define a weighing chamber; and the static eliminator according to claim 1, disposed inside the weighing chamber, wherein a table of optimum periods with respect to each distance from the static eliminating needle to the static eliminating object, or a function of an optimum period with respect to the distance from the static eliminating needle to the static eliminating object is stored, and voltage application in the high-speed static eliminating mode is performed by a pulsed DC method using an optimum period determined according to a distance corresponding to a distance from a center position of the placing pan to the static eliminator.

4. The static eliminator according to claim 1, wherein the static eliminating needle consists of a static eliminating needle of a positive electrode for emitting positive ions and a static eliminating needle of a negative electrode for emitting negative ions, in the pulsed DC method, the emission of positive ions from the static eliminating needle of the positive electrode and the emission of negative ions from the static eliminating needle of the negative electrode are alternately performed, and in the DC method, the emission of positive ions from the static eliminating needle of the positive electrode and the emission of negative ions from the static eliminating needle of the negative electrode are simultaneously performed.

5. A static eliminating method for eliminating static from a static eliminating object by ions generated by applying a high voltage to a static eliminating needle, comprising:

a high-speed static eliminating step of eliminating static from the static eliminating object at a high speed by voltage application to the static eliminating needle by a pulsed DC method; and a relaxation static eliminating step of regulating ion balances of the static eliminating object and the area around the static eliminating object by voltage application to the static eliminating needle by a DC method, which is performed after the high-speed static eliminating step.

* * * * *